US007291436B2

(12) United States Patent
Nakamura et al.

(10) Patent No.: US 7,291,436 B2
(45) **Date of Patent: *Nov. 6, 2007**

(54) ELECTROPHOTOGRAPHIC TONER, METHOD FOR PRODUCING THE SAME, ELECTROPHOTOGRAPHIC DEVELOPER, AND IMAGE FORMING METHOD

(75) Inventors: Masaki Nakamura, Minamiashigara (JP); Takashi Imai, Minamiashigara (JP); Katsumi Daimon, Minamiashigara (JP); Yuka Ishihara, Minamiashigara (JP); Hirokazu Yamada, Minamiashigara (JP); Hirokazu Hamano, Minamiashigara (JP); Norihito Fukushima, Minamiashigara (JP); Yasuhiro Arima, Minamiashigara (JP)

(73) Assignee: Fuji Xerox., Ltd., Tokyo (JP)

( * ) Notice: Subject to any disclaimer, the term of this patent is extended or adjusted under 35 U.S.C. 154(b) by 332 days.

This patent is subject to a terminal disclaimer.

(21) Appl. No.: 10/963,728

(22) Filed: Oct. 14, 2004

(65) Prior Publication Data

US 2005/0208414 A1 Sep. 22, 2005

(30) Foreign Application Priority Data

Mar. 19, 2004 (JP) ..... 2004-081208

(51) Int. Cl.
*G03G 9/093* (2006.01)

(52) U.S. Cl. ..... 430/110.2; 430/111.4; 430/111.41

(58) Field of Classification Search ..... 430/110.2, 430/111.4, 110.1, 111.41
See application file for complete search history.

(56) References Cited

U.S. PATENT DOCUMENTS

| | | | | |
|---|---|---|---|---|
| 6,413,691 | B2 * | 7/2002 | Daimon et al. | 430/109.4 |
| 6,582,869 | B2 | 6/2003 | Daimon et al. | |
| 6,607,864 | B2 * | 8/2003 | Serizawa et al. | 430/124 |

FOREIGN PATENT DOCUMENTS

| | | |
|---|---|---|
| JP | A-05-210330 | 8/1993 |
| JP | A-08-220932 | 8/1996 |
| JP | A-2000-352839 | 12/2000 |
| JP | A-2001-042568 | 2/2001 |
| JP | A-2002-082485 | 3/2002 |

* cited by examiner

*Primary Examiner*—John L Goodrow
(74) *Attorney, Agent, or Firm*—Oliff & Berridge, PLC

(57) ABSTRACT

An electrophotographic toner having a core-shell structure including a crystalline resin in its core region or a sea-island structure including a crystalline resin in its island region, wherein the toner has 1) a resistance of $5.0\times10^{12}$ Ω·cm or higher, 2) a dynamic viscosity coefficient of $3\times10^{3}$ Pa·s or higher at a temperature which is 50° C. higher than a melting point of the crystalline resin, and 3) a dynamic viscosity coefficient of $1\times10^{5}$ Pa·s or lower at a temperature which is 10° C. higher than the melting point of the crystalline resin.

19 Claims, 1 Drawing Sheet

ELECTROPHOTOGRAPHIC TONER, METHOD FOR PRODUCING THE SAME, ELECTROPHOTOGRAPHIC DEVELOPER, AND IMAGE FORMING METHOD

CROSS-REFERENCE TO RELATED APPLICATION

This application claims priority under 35 USC 119 from Japanese patent Application No. 2004-81208, the disclosure of which is incorporated by reference herein.

BACKGROUND OF THE INVENTION

1. Field of the Invention

The present invention relates to an electrophotographic toner, an electrophotographic developer, and an image forming method. More specifically, the invention relates to an electrophotographic toner used in an instrument using an electrophotographic method, such as a copying machine, a printer or a facsimile, in particular, a color copying machine; a method for producing the toner; an electrophotographic developer; and an image forming method using the developer.

2. Description of the Related Art

In recent years, the electrophotographic method has widely been used not only in copying machines but also in printers, such as network printers in offices, printers for personal computers and printers for on-demand printing, as information instruments have been developing and communication networks have been making progress in information society. Such characteristics are more strongly requested as high image quality, high speed, high reliability, compactness, lightness, and energy-saving in both fields of monochromic and color electrophotographic processes.

In the electrophotographic method, a fixed image is usually formed through a process comprising: forming an electrostatic latent image on a photoreceptor comprising a photoconductive material by means of various units; using a toner to develop this latent image; transferring the toner image on the photoreceptor, through an intermediate body or without an intermediate body, onto a image receiving body such as a sheet; and then fixing this transferred image onto the image receiving body.

In general, the contact type fixing method, which is widely used as a toner-fixing method, is a method in which heat and pressure are used when a toner image is fixed (hereinafter referred to as the "heating and pressing method"). In the case of this heating and pressing method, the surface of a fixing member and a toner image on a image receiving body contact each other under pressure. Accordingly, the method gives a very high heat efficiency and makes rapid fixation possible. In particular, the method is very useful for high-speed electrophotographic image forming devices.

In recent years, energy-saving performance has been increasingly required. Thus, investigation on low-temperature fixation has been advanced in order to decrease power consumption when a toner is fixed. As a result, several documents report toners comprising a crystalline resin as a binder resin. For example, Japanese Patent Application Laid-Open (JP-A) Nos. 2002-082485, 2000-352839 and 2001-42568 each report a toner comprising a crystalline polyester resin. However, in the case that a crystalline resin is used as a binder resin, there is caused a problem that the electrification quantity of the toner becomes low so that a sufficient developing performance cannot be obtained.

Into fixing devices, the following control is introduced for energy saving: a control which stops power supply to fixing device during standby period; or a control which maintains the fixing device at a lower temperature than a fixing temperature during standby period. Accordingly, at the time of printing, it is necessary to raise the temperature of the devices to the fixing temperature rapidly. Thus, various modifications are made in order to control the temperature of a fixing device or the temperature distribution thereof (JP-A No. 8-220932).

Further, suggested is a method of using a material having a high thermal conductivity as the surface material of a fixing device in order to lower fixing temperature (JP-A No. 5-210330).

However, in a fixing device which involves rapid temperature-rising, as described above, temperature is raised at a rate of 10 to 20° C./second. Consequently, printing starts before the surface temperature of the fixing device becomes even. For this reason, the fixing device has a broad temperature distribution and the temperature difference between the highest temperature region and the lowest temperature region becomes about 50 to 100° C. However, toner is designed to have a narrow fixable temperature range, which is a temperature range between the lowest fixable temperature of the toner to the hot offset temperature. Thus, no toner having a broad fixable temperature range (a broad fixing latitude) has been obtained. If the surface of a fixing device has a high thermal conductivity, the fixing temperature thereof can be lowered. However, the releasing properties thereof become poor so that the fixing temperature range becomes narrow since fixing devices which are good in both of thermal conductivity and releasing properties have not yet been developed (conventional fixing device surfaces made of fluororesin or silicone resin are poor in thermal conductivity, and fixing device surfaces made of alumina, which has a high thermal conductivity, are poor in releasing properties).

For energy saving, the low-temperature fixing toners including a crystalline resin as a binder resin are effective. However, crystalline-resin-containing toners which have been reported hitherto cannot attain a broad fixable temperature range. Thus, the crystalline-resin-containing toners are unsuitable for forming an image by use of a fixing member having a high thermal conductivity, such image formation requiring a broad fixable temperature range of toners.

Accordingly, a toner which has a sufficient image-forming properties and which can be used to form an image by use of a fixing member having a high thermal conductivity has not yet been obtained.

SUMMARY OF THE INVENTION

The present invention has been made in light of the above-mentioned problems.

A first aspect of the invention is to provide an electrophotographic toner, wherein the toner has a core-shell structure comprising a crystalline resin in the core region or a sea-island structure comprising a crystalline resin in the island region, and the toner has 1) a resistance of $5.0\times10^{12}$ Ω·cm or higher, 2) a dynamic viscosity coefficient of $3\times10^{3}$ Pa·s or higher at a temperature which is 50° C. higher than a melting point of the crystalline resin, and 3) a dynamic viscosity coefficient of $1\times10^{5}$ Pa·s or higher at a temperature which is 10° C. higher than a melting point of the crystalline resin.

A second aspect of the invention is to provide a method for producing the electrophotographic toner having the core-shell structure according to the first aspect, comprising: mixing a fine particle liquid dispersion of binder resins comprising the crystalline resin with a fine particle liquid dispersion of the coloring agent; and heating the mixture to a temperature which is not lower than the glass transition temperature or the melting point of the binder resin to aggregate and coalesce the particles of the binder resin and coloring agent.

A third aspect of the invention is to provide an electrophotographic developer which comprises a toner and a carrier, wherein the toner comprises a binder resin and a coloring agent, the toner has a core-shell structure comprising a crystalline resin in the core region or a sea-island structure comprising a crystalline resin in the island region, and the toner has 1) a resistance of $5.0\times10^{12}$ Ω·cm or higher, 2) a dynamic viscosity coefficient of $3\times10^{3}$ Pa·s or higher at a temperature which is 50° C. higher than a melting point of the crystalline resin, and 3) a dynamic viscosity coefficient of $1\times10^{5}$ Pa·s or higher at a temperature which is 10° C. higher than a melting point of the crystalline resin.

A fourth aspect of the invention is to provide an image forming method comprising: forming an electrostatic latent image on a photoreceptor; developing the electrostatic latent image with a developer comprising a toner and a carrier to form a toner image; transferring the toner image on the photoreceptor onto a image receiving body; and fixing the toner image thermally onto the image receiving body, wherein the toner comprises a binder resin and a coloring agent, the toner has a core-shell structure comprising a crystalline resin in the core region or a sea-island structure comprising a crystalline resin in the island region, and the toner has 1) a resistance of $5.0\times10^{12}$ Ω·cm or higher, 2) a dynamic viscosity coefficient of $3\times10^{3}$ Pa·s or higher at a temperature which is 50° C. higher than a melting point of the crystalline resin, and 3) a dynamic viscosity coefficient of $1\times10^{5}$ Pa·s or higher at a temperature which is 10° C. higher than a melting point of the crystalline resin.

The toner may be fixed with an electrophotographic fixing device comprising a fixing member whose surface has a thermal conductivity of 1 W/mK or higher

DESCRIPTION OF THE PRESENT INVENTION

Figure 1:
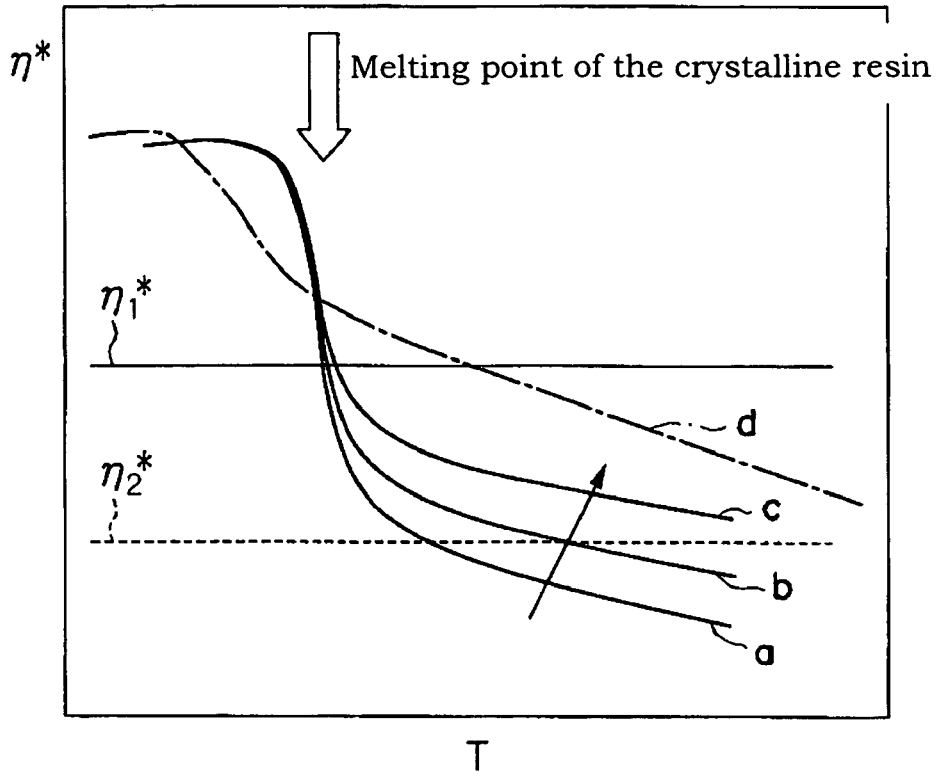
FIGS. 1 and 2 are graphs for explaining the viscoelastic behavior of the electrophotographic toner of the present invention.

In the following, the electrophotographic toner, which may be referred to merely as the "toner" hereinafter, of the invention; the electrophotographic developer, and the method for forming an image using the toner or the developer are described.

[Electrophotographic Toner]

An embodiment of the invention is to provide an electrophotographic toner having a core-shell structure including a crystalline resin in its core region or a sea-island structure including a crystalline resin in its island region, wherein the toner has 1) a resistance of $5.0\times10^{12}$ Ω·cm or higher, 2) a dynamic viscosity coefficient of $3\times10^{3}$ Pa·s or higher at a temperature which is 50° C. higher than a melting point of the crystalline resin, and 3) a dynamic viscosity coefficient of $1\times10^{5}$ Pa·s or lower at a temperature which is 10° C. higher than the melting point of the crystalline resin.

The toner may be fixed with an electrophotographic fixing device comprising a fixing member whose surface has a thermal conductivity of 1 W/mK or higher.

The crystalline resin may be a crystalline polyester. A proportion of the crystalline resin may be 30% by mass to 90% by mass. The crystalline resin may be exposed on less than 20% of a surface area of the toner. The melting point of the crystalline resin may be 40° C. to 100° C. A weight-average molecular weight of the crystalline resin may be 8,000 to 100,000. The toner may further comprises a releasing agent in an amount of 0.1% by mass to 20% by mass. The releasing agent may have a melting point of 40 to 150° C. The toner may further comprise silica particles. The silica particles may have been subjected to a hydrophobicity-imparting treatment. A volume-mean particle diameter of the silica particles may be 1 nm to 1,000 nm. A volume-mean particle diameter of the toner may be 3 to 20 μm. A volume-particle-diameter distribution of the toner may be 1.35 or less.

The toner of the invention may comprise a binder resin and a coloring agent, and may also comprise other additives. The toner has a core-shell structure or a sea-island structure, and its core region or island region comprises a crystalline resin. When the toner is heated, the crystalline resin rapidly melts at the melting point of the crystalline resin so that the low-temperature fixability of the electrophotographic toner is attained. For the low-temperature fixability, the melting point of the crystalline resin is preferably from 60 to 95° C., more preferably from 65 to 90° C. When the melting point of the crystalline resin is within the range of 60 to 95° C., the glass transition point of the crystalline resin could be not higher than room temperature. Therefore, the melt viscosity of the crystalline resin tends to be smaller than that of a non-crystalline resin with the same molecular weight having a glass transition temperature of 50 to 70° C.

It is therefore preferable, for example, to use a crystalline resin having a higher molecular weight than conventional non-crystalline resins, or increase the melt viscosity of the toner by ion-crosslinking (such as ion-crosslinking of chains of the crystalline resin molecules generated in the aggregation-coalescence method with a metal ion coagulant); as a result, it becomes possible to prevent hot offset when the toner is fixed. The melt viscosity of the crystalline resin is preferably 100 Pa·s or higher, more preferably from 500 Pa·s or higher. The upper limit of the melt viscosity is preferably 10,000 Pa·s or lower from the viewpoint of low-temperature fixability of the toner.

Furthermore, the toner has 1) a resistance of $5.0\times10^{12}$ Ω·cm or higher, 2) a dynamic viscosity coefficient of $3\times10^{3}$ Pa·s or higher at a temperature which is 50° C. higher than a melting point of the crystalline resin, and 3) a dynamic viscosity coefficient of $1\times10^{5}$ Pa·s or higher at a temperature which is 10° C. higher than a melting point of the crystalline resin.

When the resistance of the toner is $5.0\times10^{12}$ Ω·cm or higher, electrification quantity of the toner is sufficient and the toner has a good developing properties. The toner resistance is preferably $1.0\times10^{12}$ Ω·cm or higher. The upper limit of the resistance is about $1.0\times10^{15}$ Ω·cm.

The resistance is measured by compression-molding 4 g of toner powder into a disc, seasoning the disc to a high-temperature and high-humidity environment (28° C. and 85% RH) for 10 hours, and then measuring the volume resistance thereof.

The toner resistance can be adjusted by changing factors such as the content of the crystalline resin, the amount of polar groups in the crystalline resin.

The dynamic viscosity coefficient ($\eta^*$) is measured by a rheometer at a frequency of 1 rad/second with a temperature-raising rate of 1° C./minute starting from the melting point. The dynamic viscosity coefficient is measured 1° C. by 1° C. The measurement strain is adjusted to 20% or less, and different parallel plates having a diameter of 8 mm and a diameter of 25 mm, respectively, are used in accordance with the measurement torque.

In order to prevent hot offset, the dynamic viscosity coefficient of the toner has to be $3\times10^3$ Pa·s or higher, preferably $7\times10^3$ Pa·s or higher at a temperature which is higher than the melting point of the crystalline resin by 50° C. The upper limit of the dynamic viscosity coefficient is about $1\times10^5$ Pa·s, considering cold offset.

In order for the crystalline resin to fluidize rapidly when the temperature is raised beyond the melting point of the crystalline resin and to exhibit low-temperature fixability, the dynamic viscosity coefficient of the toner has to be $1\times10^5$ Pa·s or smaller, preferably $5\times10^4$ Pa·s or smaller at a temperature higher than the melting point by 10° C. The lower limit of the dynamic viscosity coefficient is about $3\times10^3$ Pa·s, considering hot offset.

The dynamic viscosity coefficient can be adjusted, for example by changing the content of the binder resin in the core or island regions or the shell or sea regions, the molecular weight of the binder resin, in particular, the molecular weight of the crystalline resin contained in the core or island regions, the acid value of the crystalline resin, by determining whether a coagulant is added during the aggregation-coalescence process or not, or by selecting the kind of the coagulant.

Figure 2:
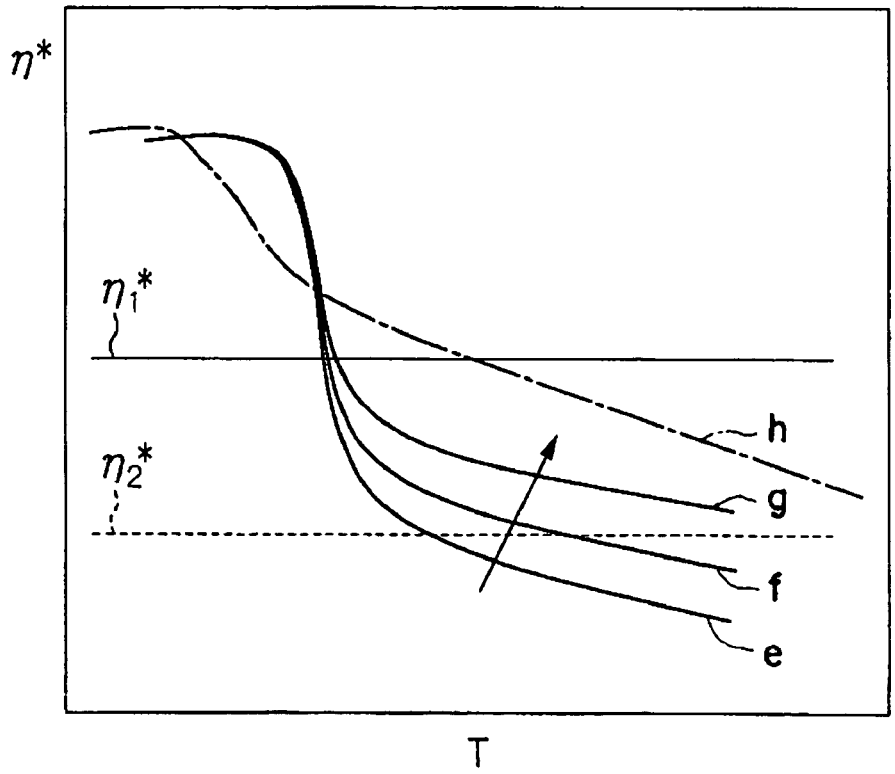

FIGS. 1 and 2 are graphs for explaining the viscoelasticity behavior of the electrophotographic toner of the invention. In each of FIGS. 1 and 2, the transverse axis represents temperature (T), and the vertical axis represents the dynamic viscosity coefficient ($\eta^*$) of the electrophotographic toner.

In FIG. 1, curves a, b and c show relationships between temperature and the dynamic viscosity coefficients of the crystalline resins having different molecular weights, and demonstrate that the dynamic viscosity coefficient becomes higher as the molecular weight of the crystalline resin increases (an arrow crossing the curves a, b and c shows the direction in which the molecular weight increases). In FIG. 1, $\eta^*_1$ represents a standard of the dynamic viscosity coefficient at the lowest fixable temperature, and $\eta^*_2$ represents a standard of the viscosity at which hot offset occurs (the meanings of $\eta^*_1$ and $\eta^*_2$ in FIG. 2 are the same as in FIG. 1); and the outlined arrow represents the melting point of the crystalline resin. In FIG. 1, a curve d represents a relationship in the case of a toner comprising a non-crystalline resin.

In FIG. 2, curves e, f and g show relationships between temperature and the dynamic viscosity coefficients of the crystalline resins when the valence or amount of coagulant is changed. FIG. 2 demonstrates that the dynamic viscosity coefficient becomes higher as the valence or amount increases (an arrow crossing the curves e, f and g shows the direction in which the valence or amount of the coagulant increases). In FIG. 2, a curve h represents a relationship in the case of a toner comprising a non-crystalline resin.

As shown in FIGS. 1 and 2, if a toner comprises a crystalline resin, the dynamic viscosity coefficient of the melted toner can easily be controlled within the range of from $\eta^*_1$ to $\eta^*_2$ by selecting a crystalline resin with a suitable molecular weight or by suitably determining the valence or amount of the coagulant. As a result, a toner having broad development latitude can be obtained. The lowest fixable temperature of the toner is low. On the other hand, if a toner comprises a non-crystalline resin, it is difficult to make the toner have a dynamic viscosity coefficient within the range of $\eta^*_1$ to $\eta^*_2$ over a broad temperature range. Moreover, the lowest fixable temperature of the toner comprising a non-crystalline resin is high.

The toner of the invention has a core-shell structure or a sea-island structure. Its core region or island region comprises a crystalline resin. In other words, the toner of the invention is in such a form that the crystalline resin is secluded from the toner surface.

When a crystalline resin is used as the binder resin for low-temperature fixation, it is preferable for the crystalline resin to includes polar groups in order to improve adhesion of the toner onto paper. However, if the crystalline resin including polar groups has a glass transition temperature which is not higher than room temperature, the resistance of the resin is low and toner charge is insufficient. Its reason could be as follows. Since the glass transition temperature is not higher than room temperature, whilst macroscopic movements of the crystalline resin molecules are restrained by the crystal arrangement thereof, microscopic movements in non-crystalline regions in the resin are allowed so that electric charges are transported through the polar groups. As a result, the crystalline resin is a semi-conductive ($10^8$ to $10^{13}$ Ωm) resin and the toner charge is insufficient because of charge leakage. This is in contrast to resins having a glass transition temperature not lower than room temperature, which is an insulator (about $10^{14}$ Ωm or higher).

Therefore, the toner of the invention has a core-shell structure or a sea-island structure as described above so that the crystalline resin, which has a low resistance, is covered with a material having a high resistance (the shell region or sea region). The toner charge is secured by this structure which prevent exposure of the crystalline resin.

The material which constitutes the shell regions of the core-shell toner or the sea regions of the sea-island toner (shell-forming material) is preferably a material having a high resistance. The resistance is preferably $10^{14}$ Ω·cm or higher. For example, insulative resin, insulative inorganic powder or a combination thereof may be used.

The resin is not particularly limited, and may be a vinyl resin or a polyester resin which has been used as a conventional toner resin. Non-crystalline resin which will be described later is also preferable.

The inorganic powder is not particularly limited, and is preferably inorganic powder whose surface is subjected to hydrophobicity-imparting treatment in order to improve environmental stability of toner charge.

The proportion of crystalline resins in the core-shell structure toner or the sea-island structure toner of the invention is preferably 30% or higher, more preferably 50% or higher, even more preferably 70% or higher by mass in order to improve low-temperature fixability. The upper limit thereof is preferably 90% or lower in order to secure sufficient toner charge.

The inner structure of the toner can be confirmed by observing sections thereof with a TEM (transmission electron microscope).

As described above, the toner of the invention comprises a crystalline resin. The toner has a core-shell structure which comprises the crystalline resin in its shell region or a sea-island structure which comprises the crystalline resin in its island region. The crystalline resin, which has a low resistance, is covered with the shell region or sea region, which has a high resistance, so that the resistance of the toner is high enough to obtain a desired toner charge. A toner in which a slight amount (20% or less) of the crystalline resin is exposed (present on the toner surface) is within the scope of the invention so long as the resistance of the toner is within the above-mentioned range.

The crystalline resin included in the toner of the invention is a resin having a melting point, and is specifically a resin having an endothermic peak according to thermal analysis by a differential scanning calorimetry (DSC). The melting point of the crystalline resin is preferably 40° C. or higher, more preferably 60° C. or higher, and is preferably 100° C. or lower, more preferably 90° C. or lower. The melting point of the crystalline resin is preferably from 60 to 95° C. in order to obtain a good low-temperature fixability.

If the melting point of the crystalline resin is too low, the toner might undergo blocking when the toner is stored or used. If the melting point is too high, satisfactory low-temperature fixability might not be attained.

The melting point of the crystalline resin can be obtained as a melting peak temperature on the basis of input-compensation differential scanning calorimetry described in JIS K 7121, which corresponds to ISO3146 plastics-determination of melting behavior (melting temperature of melting range) of semi-crystalline polymers. JIS K 7121 is incorporated herein by reference. When the resin has plural melting peaks, the largest melting peak among the peaks is regarded as the melting point.

The molecular weight of the crystalline resin is not particularly limited. Usually, the weight-average molecular weight is preferably 8,000 or larger, more preferably 10,000 or larger, and is preferably 100,000 or smaller, more preferably 70,000 or smaller. If the molecular weight of the crystalline resin is too small, strength of the fixed image might be insufficient and the toner might break when the toner is stirred in a developing device. If the molecular weight of the crystalline resin is too large, the fixable temperature of the toner might be elevated.

The crystalline resin is preferably a polyester resin.

Specific examples of the polyester resin include poly-1,2-cyclopropenedimethylene isophthalate, polydecamethylene adipate, polydecamethylene azelate, polydecamethylene oxalate, polydecamethylene sebacate, polydecamethylene succinate, polyeicosamethylene malonate, polyethylene-p-(carbophenoxy)butylate, polyethylene-p-(carbophenoxy)undecanoate, polyethylene-p-phenylene diacetate, polyethylene sebacate, polyethylene succinate, polyhexamethylene carbonate, polyhexamethylene-p-(carbophenoxy)undecanoate, polyhexamethylene oxalate, polyhexamethylene sebacate, polyhexamethylene suberate, polyhexamethylene succinate, poly-4,4-isopropylidenediphenylene adipate, and poly-4,4-isopropylidenediphenylene malonate.

Other examples thereof include trans-poly-4,4-isopropylidenediphenylene-1-methylcyclopropane dicarboxylate, polynonamethylene azelate, polynonamethylene terephthalate, polyoctamethylene dodecanedioate, polypentamethylene terephthalate, trans-poly-m-phenylenecyclopropane dicarboxylate, cis-poly-m-phenylenecyclopropane dicarboxylate, polytetramethylene carbonate, polytetramethylene-p-phenylene diacetate, polytetramethylene sebacate, polytrimethylene dodecanedioate, polytrimethylene octadecanedioate, polytrimethylene oxalate, polytrimethylene undecanedioate, poly-p-xylene adipate, poly-p-xylene azelate, poly-p-xylene sebacate, polydiethylene glycol terephthalate, cis-poly-1,4-(2-butene)sebacate, and polycaprolactone. It is also possible to use a copolymer of some of the ester monomers used in the above-listed polymers and/or a copolymer of some of the ester monomers and other monomers which can copolymerize with the ester monomers.

The binder resin used in the electrophotographic toner of the invention may include a non-crystalline resin together with the crystalline resin. The non-crystalline resin is a resin which has no endothermic peak according to thermal analysis by a differential scanning calorimetry (DSC) and which is a solid at ambient temperature and is thermally plasticized at temperatures not lower than the glass transition temperature thereof.

Examples of the non-crystalline resin include polyamide resin, polycarbonate resin, polyether resin, polyacrylonitrile resin, polyarylate resin, polyester resin, and styrene-acrylic resin. Usually, the polyester resin can be synthesized by selecting an appropriate combination of a dicarboxylic acid component and a diol component, and applying a method known in the related art, such as a transesterification or polycondensation method.

Examples of the dicarboxylic acid component include terephthalic acid, isophthalic acid, cyclohexanedicarboxylic acid, naphthalene dicarboxylic acids (such as naphthalene-2,6-dicarboxylic acid and naphthalene-2,7-dicarboxylic acid), and biphenyldicarboxylic acid. Other examples thereof include dibasic acids such as succinic acid, glutaric acid, adipic acid, suberic acid, azelaic acid, sebacic acid, phthalic acid, malonic acid and mesaconic acid, anhydrides thereof, and lower alkyl esters thereof; and aliphatic unsaturated dicarboxylic acids such as maleic acid, fumaric acid, itaconic acid, and citraconic acid. A carboxylic acid having three or more valences such as 1,2,4-benzenetricarboxylic acid, 1,2,5-benzenetricarboxylic acid or 1,2,4-naphthalenetricarboxylic acid, an anhydrate thereof, or a lower alkyl ester thereof may be used together with dicarboxylic acids. In order to adjust the acid value or hydroxyl value thereof, a monobasic acid such as acetic acid or benzoic acid may be used if necessary.

Examples of the diol component include ethylene glycol, propylene glycol, neopentyl glycol, cyclohexanedimethanol, an ethylene oxide adduct of bisphenol A, a trimethylene oxide adduct of bisphenol A, bisphenol A, hydrogenated bisphenol A, 1,4-cylohexanediol, 1,4-cyclohexanedimethanol, diethylene glycol, dipropylene glycol, 1,3-butanediol, 1,4-butanediol, 1,5-pentanediol, 1,6-hexanediol, and neopentyl glycol. Alcohols having three or more valences, such as glycerin, trimethylolethane, trimethylolpropane and pentaerythritol, may be used together in sparing amounts. Only a single kind of diol may be used or a plurality kinds of diols may be used in combination. A monovalent alcohol such as cyclohexanol or benzyl alcohol may be used.

The electrophotographic toner of the invention usually includes a coloring agent. The coloring agent is not particularly limited and may be any known coloring agent, and is appropriately selected in accordance with purpose. Specific examples thereof include carbon black, lamp black, aniline blue, ultramarine blue, chalcoil blue, methylene blue chloride, copper phthalocyanine, quinoline yellow, chrome yellow, DU PONT oil red, ORIENT oil red, rose bengal, malachite green oxalate, nigrosin dye, C.I. Pigment Red 48:1, C.I. Pigment Red 57:1, C.I. Pigment Red 81:1, C.I. Pigment Red 122, C.I. Pigment Yellow 97, C.I. Pigment Yellow 12, C.I. Pigment Yellow 17, C.I. Pigment Blue 15:1, and C.I. Pigment Blue 15:3.

Usually, the content of the pigment(s) is preferably 1 part or more by mass per 100 parts by mass of the binder resin, and is preferably 30 parts or less, more preferably 20 parts or less by mass per 100 parts by mass of the binder resin. If the content of the coloring agent is too small, a large amount of the toner might be necessary for developing a color. If the content of the coloring agent is too large, the melt viscosity of the toner increases so that the fixable temperature thereof may rise. A larger content of the coloring agent is preferred as long as the smoothness of the image surface after fixation of the toner is secured. If a toner with a higher content of coloring agents is used, image thickness necessary for the same image density is thinner and offset is effectively prevented. The toner may be a yellow toner, a magenta toner, a cyan toner, a black toner or the like depending on the kind of the coloring agent.

The toner may usually include various known additives such as a releasing agent, inorganic particles, organic particles, and a charge controlling agent. The additives are not particularly limited and may be appropriately selected in accordance with purpose.

The releasing agent may be a wax. Examples of the wax include paraffin waxes such as low molecular weight polypropylenes and low molecular weight polyethylenes; silicone resins; rosins; rice wax; and carnauba wax. The melting point of the wax is preferably from 40 to 150° C., more preferably from 60 to 110° C. The amount of the waxes to be used is not particularly limited, and is usually 0.1% or larger, preferably 0.5% or larger by mass in the electrophotographic toner. The amount is preferably 20% or smaller by mass in the electrophotographic toner. If the content of the wax is too small, releasing properties might be insufficient particularly in oilless fixation. If the content of the wax is too large, color image quality or reliability might deteriorate, for example owing to reduced toner fluidity.

Examples of the inorganic fine particles include particles made of silica, alumina, titanium oxide, barium titanate, magnesium titanate, calcium titanate, strontium titanate, zinc oxide, siliceous sand, clay, mica, wollastonite, diatomaceous earth, cerium chloride, red iron oxide, chromium oxide, cerium oxide, antimony trioxide, magnesium oxide, zirconium oxide, silicon carbide and silicon nitride. Of these particles, silica fine particles are preferable and silica particles which have been subjected to a hydrophobicity-imparting treatment are particularly preferable. The inorganic particles are used to improve the fluidity of the electrophotographic toner. The primary particle size of the inorganic fine particles is preferably 1 nm or larger, more preferably 10 nm or larger, and is preferably 1000 nm or smaller, more preferably 300 nm or smaller. The amount of the inorganic particles to be added is preferably 0.01 part or more and 20 parts or less by mass per 100 parts by mass of the electrophotographic toner.

Examples of the organic particles include particles made of polystyrene, polymethyl methacrylate, and polyvinylidene fluoride. The organic particles are used to improve the cleanability of the electrophotographic toner and the transferability thereof.

Examples of the charge controlling agent include metal salts of salicylic acid, metal-containing azo compounds, nigrosin, and quaternary ammonium salts. The charge controlling agent is used to improve the electric chargeability of the electrophotographic toner.

As the method for producing the toner of the invention, a wet toner-producing method which has been used conventionally may be used. Examples of this wet toner-producing method include an aggregation-coalescence method of mixing a resin particle liquid dispersion, a coloring agent particle liquid dispersion, and the like, and heating the mixture up to a temperature not lower than the glass transition temperature or the melting point of the resin so as to melt and coalesce the aggregated particles, thereby forming the toner (see, for example, JP-A No. 2002-82473); an in-liquid drying method (see, for example, JP-A No. 63-25664); a method of applying shearing force to a melted toner in a toner-indissoluble liquid while stirring the liquid, thereby producing particles; and a method of dispersing a binder resin and a coloring agent in a solvent and then jet-spraying the liquid dispersion to form fine particles. Of these methods, the aggregation-coalescence method is preferable. Other examples of conventional methods which may be used include dry toner-producing methods, such as a kneading-pulverizing method, which comprises the step of melting and kneading a binder resin, a pigment, a charge controlling agent, and a releasing agent such as wax, cooling the resultant mixture, pulverizing the mixture into particles, and then classifying the fine particles and a kneading-freezing-pulverizing method.

The aggregation-coalescence method is a method of mixing a resin particle liquid dispersion, a coloring agent particle liquid dispersion, and the like to prepare a liquid dispersion of aggregated particles including the binder resin particles and the coloring agent particles, and heating the mixture up to a temperature not lower than the glass transition temperature or the melting point of the binder resin so as to melt and coalesce the resultant aggregated particles, thereby forming toner particles. The binder resin particle liquid dispersion can be prepared by methods such as emulsion polymerization and compulsory emulsification. The coloring agent particle liquid dispersion can be prepared, for example, by dispersing the coloring agent with an ionic surfactant having the opposite polarity to that of the ionic surfactant contained in the binder resin particle liquid dispersion. Next, the resin particle liquid dispersion, the coloring agent particle liquid dispersion, and the like are mixed, thereby causing hetero-aggregation which provides aggregated particles having a particle size corresponding to a toner particle size. Thereafter, the system is heated to a temperature not lower than the glass transition temperature or the melting point of the binder resin particles, thereby melting the aggregated particles and obtaining toner particles.

As described above, the operation for generating the hetero-aggregation may be, but not limited to, an operation of mixing the binder resin particle liquid dispersion, the coloring agent liquid dispersion, the releasing agent dispersion, and the like in a lump. For example, the following operation may also be employable: shifting the initial balance of the amount of a polar ionic surfactant in advance (for example, using an inorganic metal salt (such as calcium nitrate), a quadrivalent aluminum salt (such as polyaluminum chloride or polyaluminum hydroxide) or a polymer thereof to neutralize ions of the surfactant); forming aggregated parent particles at a temperature lower than the glass transition temperature; stabilizing the particles (the steps up to this step are included in the first stage, the following steps are included in the second stage); adding thereto a particle liquid dispersion having such a polarity in such an amount that the shift of the ion balance is compensated; optionally heating the resultant particles slightly to a temperature not higher than the glass transition temperature or the melting point of the resin contained in the parent particles or the added particles to stabilize the particles at a higher temperature; and heating the particles to a temperature not lower than the glass transition temperature or the melting point so as to melt the particles while the particles added in the second stage adhere to the surface of the aggregated parent particles, thereby obtaining toner particles. Furthermore, the second stage may be repeated plural times.

In the toner-producing method of the invention, such an aggregation-coalescence method is used to make it possible to produce a toner having a core-shell structure or a sea-island structure. This method is described hereinafter.

A first method for producing a toner having a core-shell structure is a method of mixing a particle liquid dispersion of a binder resin including a crystalline resin with a coloring agent particle liquid dispersion, and then heating this mixed liquid dispersion to a temperature not lower than the glass transition temperature or the melting point of the binder resin, thereby aggregating and coalescing the binder resin particles and the coloring agent particles. The binder resin in the "particle liquid dispersion of the binder resin including the crystalline resin" includes the binder resin which will form cores (and comprises the crystalline resin), and a shell-forming material, which will form shells.

In this method, it is preferable to use, as the binder resin which will form cores, a material having a higher hydrophobicity than the shell-forming material. Examples of this material, which has a high hydrophobicity, include a crystalline resin whose molecular skeleton includes no sulfonic acid groups or only a slight amount of sulfonic acid groups; and a crystalline resin having an acid value of 30 mgKOH or less. Particles of the shell-forming resin, which has a higher hydrophilicity, may be vinyl type emulsification-polymerized particles prepared in the form of an aqueous liquid dispersion by using a water-soluble radical initiator such as ammonium persulfate; aromatic polyester resin particles prepared in the form of an aqueous liquid dispersion by a compulsory emulsification method; or the like. When such a shell-forming material is used, the shell-forming material moves to outer portion of the aggregated particles in the aggregation-coalescnece method, thereby forming shells easily.

A second method for producing a toner having a core-shell structure is a method of mixing a particle liquid dispersion of a binder resin including a crystalline resin with a coloring agent particle liquid dispersion, heating this mixed liquid dispersion to a temperature not lower than the glass transition temperature or the melting point of the binder resin, so as to aggregate and coalesce the binder resin particles and the coloring agent particles to prepare a core liquid dispersion, and then mixing the thus-prepared core liquid dispersion with a particle liquid dispersion of a shell-forming material to form shells on the surfaces of the cores. When the shells are formed, it is preferable to heat the liquid dispersion up to a temperature which is not higher than the melting point of the cores and which is substantially equal to the glass transition temperature of the shell-forming material. The shell-forming material may be selected from the materials described above. The binder resin in the above-described "particle liquid dispersion of the binder resin including the crystalline resin" includes the binder resin which will form cores (and includes the crystalline resin).

The method for producing a toner having a sea-island structure may be a method of mixing a particle liquid dispersion of a binder resin including a crystalline resin with a coloring agent particle liquid dispersion, and then heating this mixed liquid dispersion to a temperature not lower than the glass transition temperature or the melting point of the binder resin, thereby aggregating and coalescing the binder resin particles and the coloring agent particles to produce a toner which has a sea-island structure. The binder resin in the "particle liquid dispersion of the binder resin including the crystalline resin" includes the binder described above as the resin which will form cores (and includes the crystalline resin) and the shell-forming material described above as the material which will form shells.

When the above-mentioned toner, which has a core-shell structure or a sea-island structure, is produced, a releasing agent particle liquid dispersion may also be added in addition to the particle liquid dispersion of the binder resin and the coloring agent particle liquid dispersion before the aggregation and coalescence, thereby making it possible to aggregating and coalescing the binder resin particles, the coloring agent particles, and the releasing agent particles. The releasing agent liquid dispersion can be prepared by dispersing the releasing agent with a surfactant by an emulsifier such as a homogenizer.

After the toner liquid dispersion is prepared by the above-mentioned method, the toner particles are washed and dried to yield a toner. Considering the electric chargeability of the toner, it is preferable to wash the toner sufficiently with ion exchange water so that ions are exchanged. Separation of the solids from the liquid after the washing may be performed without a particular limitation. For the separation, suction filtration, pressure filtration or the like is preferably used from the viewpoint of the productivity of the toner. The method for drying the solid is not particularly limited, either. The drying method is preferably a freeze drying, a flash-jet drying, a fluidization drying, a vibration-type fluidization drying, or the like.

The volume-mean particle size of the electrophotographic toner of the invention is not particularly limited, and is usually from 3 to 20 μm, preferably from 4 to 15 μm. If the particle size is too large, noises in the image might increase. If the particle size is too small, the powder fluidity, the developing properties and the transferability of the toner may be degraded. The particle size distribution thereof is usually 1.35 or less, preferably 1.3 or less. If the particle size distribution is too large, the transferability might be degraded and fogging might be caused in the background of the image.

[Electrophotographic Developer]

The electrophotographic toner of the invention is combined with a carrier, whereby an electrophotographic developer can be prepared. The carrier is not particularly limited. The carrier may be coated with a resin. The carrier may be a carrier made of magnetic particles such as iron, ferrite, iron oxide, or nickel particles; a resin-coat carrier which has a resin coat and which is obtained by coating magnetic particles as core material with a resin (such as styrene-based resin, vinyl-based resin, ethyl-based resin, rosin-based resin, polyester resin, or methyl-based resin) or a wax such as stearic acid; or a magnetic-material dispersed carrier which is obtained by dispersing magnetic particles in a binder resin. The resin-coat carrier is particularly preferable since the electric chargeability of the toner and the whole resistance of the carrier can be controlled by suitably selecting the structure of the resin coat. About the blend ratio between the electrophotographic toner and the carrier, the amount of the toner is usually from 2 to 10 parts by mass per 100 parts by mass of the carrier. The method for preparing the developer is not particularly limited, and may be, for example, a method of mixing the toner and carrier by a V-blender or the like.

[Image Forming Method]

The above-mentioned toner or developer is used to form a toner image by the image forming method of the invention comprising: forming an electrostatic latent image on a latent image bearing body, using the developer of the invention to develop the electrostatic latent image, transferring the toner image on the latent image bearing body onto a image receiving body such as a sheet, and fixing the toner image thermally onto the image receiving body, wherein the thermal fixation is conducted on a surface of a fixing member, the surface having a thermal conductivity of 1 W/mK or higher.

The material used in the fixing member surface has a thermal conductivity of 1 W/mK or higher. Since this thermal conductivity is higher than that of conventionally-used fluororesin coat, the temperature for the fixation can be lowered by 30 to 40° C. when the fixing member including such a surface material with a high thermal conductivity is used. For example, if the fixing member is used for fixing the toner including a crystalline resin with a melting point of about 70° C., the fixing temperature can be 100° C. or lower.

The surface material, which has a thermal conductivity of 1 W/mK or higher, is preferably an aluminum oxide coat or a ceramic coat, which is also excellent in abrasion resistance. If necessary, a releasing agent is supplied onto the surface of the fixing member.

As each of these steps, a corresponding step in any known image forming method can be used. The latent image bearing body may be an electrophotographic photoreceptor, a recording dielectric body, or the like. For example, in the case of the electrophotographic photoreceptor, the photoreceptor is uniformly charged by a corotron electrifier, a contact electrifier or the like and is then exposed to light to form an electrostatic latent image. Next, the photoreceptor is contacted with or brought close to a developing roll whose surface has a developing layer, so that the toner particles adhere onto the electrostatic latent image and a toner image is formed on the electrophotographic photoreceptor. The formed toner image is transferred onto a image receiving body such as a sheet by use of a corotron electrifier or the like, and then the image is thermally fixed by the fixing member. In this way, a copy image is formed.

The image receiving body (recording material), which is used in the above-mentioned image forming method, is, for example, a plain paper or an OHP sheet, which is used, for example in a copying machine or a printer of electrophotographic type. In order to improve the smoothness of the surface of the fixed image further, it is preferable that the surface of the image receiving body is smooth. For example, the image receiving body is preferably a coated paper obtained by coating a plane paper with a resin or the like, or an art paper for printing.

EXAMPLES

The present invention is more specifically described by way of the following examples. However, the invention is not limited by the examples. Unless otherwise specified, the word "part(s)" and the symbol "%" in the examples and comparative examples are "part(s) by mass" and "% by mass", respectively.

Examples 1 to 3, and Comparative Examples 1 and 2

(1) Synthesis of Resins

1) Crystalline Resin A, and Crystalline Resins B to E:

The following compounds are added into a heated and dried three-neck flask: 98.0% by mole of 1,10-dodecanoic diacid and 2.0% by mole of dimethyl isophthlate-5-sodium sulfonate as acid components; 99.5% by mole of 1,9-nonanediol; and dibutyltin oxide as a catalyst (0.014% by mass with respect to the acid components). Then, the air in the flask is removed by pressure-reduction. Furthermore, nitrogen gas is put into the flask so as to change the atmosphere therein to an inert gas atmosphere. The solution is heated to 180° C. and kept at that temperature for 6 hours while mechanically stirred. Thereafter, the temperature is gradually raised to 220° C. under a reduced pressure. The solution is then stirred for 4 hours. When the solution becomes viscous, the molecular weight thereof is measured by GPC. When the weight-average molecular weight becomes 23,000, the pressure is returned to atmospheric pressure. The solution is then cooled with air whereby a crystalline polyester resin A is obtained. The acid value of the resultant sample resin is 10 mgKOH/g.

In the same way, resins B to E are synthesized. The melting points, the number-average molecular weights (Mn), the weight-average molecular weights (Mw), and the acid values, and the melting viscosities thereof are shown in Table 1.

2) Non-Crystalline Resin G:

Styrene, n-butyl acrylate, β-carboxyethyl acrylate, and 1,10-decanediol diacrylate respectively in the amount shown in Table 1 are mixed. Furthermore, 2.7 parts of dodecanediol are added thereto to prepare a monomer mixed solution. Next, 4 parts of an anionic surfactant (trade name: DOWFAX (transliteration), manufactured by Dow Chemical Co.) is mixed with 550 parts of ion exchange water. While the surfactant liquid is slowly stirred for 10 minutes, 6 parts of ammonium persulfate are added thereto and dissolved. In this way, a liquid dispersed-emulsion including the anionic surfactant and the ion exchange water is prepared. Subsequently, 50 parts of this liquid dispersed-emulsion is added to the monomer mixed solution and then the atmosphere in the reaction vessel is sufficiently replaced with nitrogen. Thereafter, the temperature of the mixture is raised to 70° C. and the polymerization reaction is allowed to proceed for 5 hours, thereby preparing an emulsion latex of a polystyrene-acrylic resin (non-crystalline resin G). The weight-average molecular weight (Mw) of the resultant non-crystalline resin G and the glass transition temperature thereof are shown in Table 1.

TABLE 1

| | Crystalline resin A | Crystalline resin B | Crystalline resin C | Crystalline resin D | Crystalline resin E |
|---|---|---|---|---|---|
| 1,9-Nonanediol | 99.5 mol % | 99.5 mol % | 99.5 mol % | | 99.5 mol % |
| Ethylene glycol | | | | 110.0 mol % | |
| Sebacic acid | | | | 100.0 mol % | |
| 1,10-dodecanoic diacid | 98.0 mol % | 98.0 mol % | 98.0 mol % | | 100.0 mol % |
| Dimethyl isophthalate-5-sodium sulfonate | 2.0 mol % | 2.0 mol % | 2.0 mol % | | |
| Dibutyltin oxide | 0.014% by mass of the acid components | | | | |

TABLE 1-continued

| | Crystalline resin A | Crystalline resin B | Crystalline resin C | Crystalline resin D | Crystalline resin E |
|---|---|---|---|---|---|
| Melting point | 70° C. | 70° C. | 70° C. | 69° C. | 70° C. |
| Mw | 23000 | 18000 | 30000 | 18000 | 20000 |
| Mn | 8000 | 7000 | 12000 | 13000 | 8000 |
| Acid value mgKOH/g | 10 | 12 | 8 | 10 | 12 |
| Resin viscosity | 30 Pa · s | 20 Pa · s | 60 Pa · s | 16 Pa · s | 15 Pa · s |

(2) Preparation of Binder Resin Fine Particle Liquid Dispersions

1) Liquid Dispersions of the Crystalline Resins A to E:

each of the crystalline resins A to E synthesized as described above in an amount of 100 parts and 900 parts of ion exchange water are adjusted to pH 8 with ammonia water, and then mixed at 140° C. by a disperser obtained by remodeling a cavitron CD 1010 manufactured by Eurotec Co., into a high-temperature and high-pressure type, thereby preparing a liquid dispersion of the crystalline resin which has a solid concentration of 10% and including particles having a central particle size of 0.4 μm.

2) Liquid Dispersion of the Non-Crystalline Resin G:

The emulsion latex of the non-crystalline resin G synthesized as described above is used as a non-crystalline resin G liquid dispersion. The solid concentration of the non-crystalline resin G liquid dispersion is 42%, and the central particle size of particles in the resin liquid dispersion is 0.195 μm.

(3) Measurement of Resin Properties

1) Particle Size of the Particles in each of the Binder Resin Fine Particle Liquid Dispersions:

The particle size is measured by use of a laser diffraction type particle size distribution measuring device (trade name: LA-700, manufactured by Horiba Ltd.).

2) Average Molecular Weight of each of the Resins:

A gel permeation chromatography (GPC) (trade name: HLC-8120, manufactured by TO SO Co., column: Super H3000) is used to measure the average molecular weight under the following conditions: a column oven temperature of 40° C., a column flow rate of 1 mL per minute, a sample concentration of 0.5%, and a sample injecting amount of 0.1 mL, using tetrahydrofuran (THF for GPC, manufactured by Wako Pure Chemicals, Industries) as a solvent. The measurement result is converted into a standard polystyrene (standard polystyrene sample, manufactured by TO SO Co.)-equivalent average molecular weight, utilizing a calibration curve which is determined in advance.

3) Melting Points of the Crystalline Resins A to E:

A differential scanning calorimeter (trade name: DSC60, manufactured by Shimadzu Corp.) is used to measure the melting point of each of the resins under the following conditions: a sample amount of 8 g, and a temperature-raising rate of 5° C./minute. The melting point is obtained as the temperature corresponding to a melting peak on the resultant chart sheet. When there are plural melting peaks, the temperature corresponding to the maximum peak is regarded as the melting point (unit:° C.).

4) Glass Transition Temperature of the Non-Crystalline Resin G:

The differential scanning calorimeter (trade name: DSC60, manufactured by Shimadzu Corp.) is used to measure the glass transition temperature under the following conditions: a sample amount of 8 mg, and a temperature-raising rate of 5° C./minute. The temperature corresponding to the shoulder at the low-temperature side of an endothermic peak on the resultant chart sheet is regarded as the glass transition temperature (Tg) (unit:° C.).

(4) Preparation of a Releasing Agent Fine Particle Liquid Dispersion

A homogenizer (trade name: ULTRATURRAX T50, manufactured by IKA Co.) is used to mix 50 parts of a paraffin wax (trade name: HNP-9, manufactured by Nippon Seiro Co., Ltd., melting point: 72° C.), 950 parts of ion exchange water, and 10 parts of an ionic surfactant (trade name: NEOGEN RK, manufactured by Dai-ichi Kogyo Seiyaku Co., Ltd.) at 95° C., to obtain a wax liquid dispersion. The wax liquid dispersion has a solid concentration of 10% and a central particle size of 0.5 μm.

(5) Preparation of Coloring Agent Liquid Dispersions

1) Coloring Agent Liquid Dispersion 1:

45 parts of a cyan pigment (C.I. Pigment Blue 15:3, copper phthalocyanine, manufactured by Dainichiseika Color & Chemicals Mfg. Co., Ltd.), 5 parts of ionic surfactant (trade name: NEOGEN RK, manufactured by Dai-ichi Kogyo Seiyaku Co., Ltd.), and 200 parts of ion exchange water are mixed to dissolve the pigment. The pigment is dispersed by the homogenizer (trade name: ULTRA-TURRAX T50, manufactured by IKA Co.) for 10 minutes to obtain a coloring agent liquid dispersion having a central particle size of 168 nm.

2) Coloring Agent Liquid Dispersion 2:

A coloring agent liquid dispersion 2 having a central particle size of 148 nm is obtained in the same way as in the preparation of the coloring agent liquid dispersion 1, except that 45 parts of a yellow pigment (C.I. Pigment Yellow 74, manufactured by Clariant Co.) is used in place of the cyan pigment.

3) Coloring Agent Liquid Dispersion 3:

A coloring agent liquid dispersion 3 having a central particle size of 176 nm is prepared in the same way as in the preparation of the coloring agent liquid dispersion 1 except that 45 parts of a magenta pigment (C.I. Pigment Red 122, manufactured by Dainichiseika Color & Chemicals Mfg. Co., Ltd.) is used in place of the cyan pigment.

4) Coloring Agent Liquid Dispersion 4:

A coloring agent liquid dispersion 4 having a central particle size of 250 nm is prepared in the same way as in the preparation of the coloring agent liquid dispersion 1 except that 30 parts of carbon black (trade name: REGAL 330 manufactured by Cabot Corp.) is used in place of the cyan pigment.

(6) Production of Toners (Non-External-Additive Toners) Having a Core-Shell Structure (Preparation of Core Liquid Dispersions)

The obtained crystalline resin liquid dispersion, coloring agent liquid dispersion and releasing agent liquid dispersion whose kinds and amounts are shown in Table 2 and 3 are placed a round flask made of stainless steel. While the homogenizer (trade name: ULTRA-TURRAX T50, manufactured by IKA Co.) is used to mix and disperse the components in the mixed liquid dispersions, a coagulant is added thereto as shown in Table 2 or 3. Thereafter, the liquid in flask is heated at 52° C. in a heating oil bath for 60 minutes while stirred. In this way, an aggregated particle liquid dispersion is prepared. Next, to this aggregated particle liquid dispersion is added an aqueous sodium hydroxide solution (0.5 mol/liter) so as to adjust the pH of the liquid dispersion to 7.5. Thereafter, the flask is sealed up. The liquid dispersion is heated at 80° C. for 1 hour while a magnetic force seal is used to stir the liquid dispersion.

(Formation of Shells)

The above-mentioned core liquid dispersion is cooled to room temperature and filtrated, and then to the liquid dispersion is added the shell-forming resin (non-crystalline resin G) liquid dispersion having a solid concentration of 40% in an amount shown in Table 2 or 3. While the liquid dispersion is stirred, a coagulant shown in Table 2 or 3 is added thereto. The liquid dispersion is heated to 53° C. and kept at this temperature. After 5 hours, the liquid dispersion is cooled.

(Washing)

The liquid dispersion is sufficiently washed with ion exchange water, and is then subjected to solid-liquid separating operation by Nutsche suction filtration. Furthermore, the separated solid content is again dispersed in 3 liter of ion exchange water having a temperature of 40° C., and then the liquid dispersion is stirred at 300 rpm for 15 minutes and subsequently subjected to solid-liquid separating operation by Nutsche suction filtration. This washing operation is repeated until the pH of the filtrate becomes 6.5 to 7.5 and the electric conductivity thereof becomes 10 μS/cm or lower. When the pH and the electric conductivity of the filtrate come within the above ranges, a filter paper (trade name: ADVANTEC 131) is used to subject the filtrate to solid-liquid separating operation by Nutsche suction filtration. The obtained solid is subjected to vacuum-drying at room temperature for 12 hours to obtain toner particles.

(7) Measurement of Toner Properties

The following properties of each toner are measured and the results are shown in Table 2: resistance, dynamic viscosity coefficients at temperatures which are 50° C. higher than the melting point of the crystalline resin and 10° C. higher than the melting point respectively, particle size distribution, particle size and electrification quantity.

1) Resistance:

The resistance is determined by compression-molding 4 g of powder of each toner into a disc, seasoning the disc to a high-temperature and high-humidity environment (28° C. and 85% RH) for 10 hours, and then measuring the volume resistance thereof with a high-resistance meter (trade name: R8340A, manufactured by Advantest Corp.) at an applying voltage of 500 V.

2) Dynamic Viscosity Coefficient:

When a measuring sample of each toner is set in a measuring device, the temperature of the sample is set to 10-20° C. higher than the melting point of the crystalline resin contained in the toner, then lowered to 0° C., and then heated at a temperature-raising rate of 1° C./minute. The dynamic viscosity coefficient is measured 1° C. by 1° C. from 10° C. during this temperature-raising operation.

The measuring device is a rheometer (trade name: ARES rheometer, manufactured by Rheometric Scientific Co.), and a parallel plate (diameter: 8 mm) is used to perform the above-mentioned measurement at a frequency of 1 rad/second.

3) Particle Size Distribution:

The particle size distribution of each toner is determined by using a COULTER COUNTER, TA-II model (manufactured by Coulter Co.) to measure the volume particle size thereof and then calculating the particle size distribution based on the following equation:

$$\text{Particle size distribution}=\{(D50\%\ \text{diameter}/D84\%\ \text{diameter})+(D16\%\ \text{diameter}/D50\%\ \text{diameter})\}/2$$

As the particle size of the toner, the D50% diameter of the volume particle size is used.

4) Particle Size:

The particle size of each toner is obtained by measuring the volume particle size thereof by the COULTER COUNTER TA-II model (manufactured by Beckman-Coulter Co.).

5) Electrification Quantity:

1.5 parts by mass of each electrostatic image developing toner produced to evaluate the fixability thereof (see infra) and 30 parts by mass of resin-coated ferrite particles are put into a glass bottle with a lid. The mixture in the bottle is seasoned in a high-temperature and high-humidity environment (temperature: 28° C., and humidity: 85%) for 24 hours. Thereafter, the bottle is shaken with a tumbler mixer for 5 minutes. The electrification quantity (μC) of the toner in this environment is measured with a blowoff electrification quantity measuring device.

TABLE 2

| | Toner composition | | | | | |
|---|---|---|---|---|---|---|
| | Toner structure | Main binder resin of core region or island region | Main binder resin of shell region or sea region | Coloring agent | Releasing agent | Coagulant *Polyaluminum chloride (PAC) |
| Example 1 | Core-shell | Crystalline resin A 80 g | Non-crystalline resin G 15 g | CB 5 g | Wax 15 g | At the time of forming cores: PAC 0.3 g At the time of forming shells: PAC 0.018 g |
| Example 2 | Core-shell | Crystalline resin A | Non-crystalline resin G | CB | Wax | At the time of forming |

TABLE 2-continued

| | | | | | | |
|---|---|---|---|---|---|---|
| | | 80 g | 7 g | 5 g | 15 g | cores: PAC 0.3 g<br>At the time of forming shells: PAC 0.0084 g |
| Example 3 | Core-shell | Crystalline resin B<br>80 g | Non-crystalline resin G<br>25 g | CB<br>5 g | Wax<br>15 g | At the time of forming cores: PAC 0.3 g<br>At the time of forming shells: PAC 0.03 g |
| Example 4 | Sea-island | Crystalline resin D<br>20 g | Non-crystalline resin G<br>60 g | CB<br>5 g | Wax<br>15 g | PAC 0.3 g |
| Example 5 | Sea-island | Crystalline resin E<br>60 g | Non-crystalline resin G<br>20 g | CB<br>5 g | Wax<br>15 g | PAC 0.3 g |
| Example 6 | Core-shell | Crystalline resin B<br>80 g | Non-crystalline resin G<br>15 g | CB<br>5 g | Wax<br>15 g | At the time of forming cores: PAC 0.4 g<br>At the time of forming shells: PAC 0.024 g |
| Example 7 | Core-shell | Crystalline resin A<br>80 g | Non-crystalline resin G<br>15 g | Cyan<br>5 g | Wax<br>15 g | At the time of forming cores: PAC 0.3 g<br>At the time of forming shells: PAC 0.018 g |

| | Toner properties | | | | | |
|---|---|---|---|---|---|---|
| | Resistance<br>Ω cm | Dynamic viscosity coefficient at melting point +50° C. (Pa · s) | Dynamic viscosity coefficient at Melting point +10° C. (Pa · s) | Toner particle size distribution (GSD) | Toner particle size (μm) | Electrification quantity of the toner μC/g |
| Example 1 | $3 \times 10^{13}$ | $4 \times 10^{3}$ | $4 \times 10^{4}$ | 1.27 | 6.3 | 20 |
| Example 2 | $5 \times 10^{12}$ | $3 \times 10^{3}$ | $1 \times 10^{4}$ | 1.26 | 6 | 10 |
| Example 3 | $7 \times 10^{13}$ | $6 \times 10^{3}$ | $5 \times 10^{4}$ | 1.26 | 6.4 | 30 |
| Example 4 | $4 \times 10^{13}$ | $9 \times 10^{3}$ | $9 \times 10^{4}$ | 1.27 | 6.5 | 25 |
| Example 5 | $7 \times 10^{13}$ | $1 \times 10^{4}$ | $9 \times 10^{4}$ | 1.26 | 6.8 | 30 |
| Example 6 | $3 \times 10^{13}$ | $5 \times 10^{3}$ | $5 \times 10^{4}$ | 1.26 | 6.2 | 15 |
| Example 7 | $3 \times 10^{13}$ | $4 \times 10^{3}$ | $5 \times 10^{4}$ | 1.26 | 6.4 | 20 |

TABLE 3

| | Toner composition | | | | | |
|---|---|---|---|---|---|---|
| | Toner structure | Main binder resin of core region or island region | Main binder resin of shell region or sea region | Coloring agent | Releasing agent | Coagulant *Polyaluminum chloride (PAC) |
| Comparative Example 1 | Core-shell | Crystalline resin C<br>80 g | Non-crystalline resin G<br>3 g | CB<br>5 g | Wax<br>15 g | At the time of forming cores: PAC 0.3 g<br>At the time of forming shells: PAC 0.0036 g |
| Comparative Example 2 | Core-shell | Crystalline resin B<br>80 g | Non-crystalline resin G<br>15 g | CB<br>5 g | Wax<br>15 g | At the time of forming cores: PAC 0.3 g<br>At the time of forming shells: PAC 0.03 g |
| Comparative Example 3 | Core-shell | Crystalline resin A<br>80 g | Non-crystalline resin G<br>15 g | CB<br>5 g | Wax<br>15 g | At the time of forming cores: $CaCl_2$ 0.94 g<br>At the time of forming shells: PAC 0.03 g |
| Comparative Example 4 | Without shell | Crystalline resin A<br>20 g | Not contained | CB<br>5 g | Wax<br>15 g | At the time of forming cores: PAC 0.3 g |
| Comparative Example 5 | Sea-island | Crystalline resin E<br>4 g | Non-crystalline resin G<br>76 g | CB<br>5 g | Wax<br>15 g | PAC 0.3 g |

| | Toner properties | | | | | |
|---|---|---|---|---|---|---|
| | Resistance<br>Ω cm | Dynamic viscosity coefficient at melting point +50° C. (Pa · s) | Dynamic viscosity coefficient at Melting point +10° C. (Pa · s) | Toner particle size distribution (GSD) | Toner particle size (μm) | Electrification quantity of the toner μC/g |
| Comparative Example 1 | $4 \times 10^{12}$ | $4 \times 10^{3}$ | $8 \times 10^{3}$ | 1.26 | 6 | 6 |
| Comparative Example 2 | $2 \times 10^{13}$ | $2 \times 10^{3}$ | $1 \times 10^{4}$ | 1.26 | 6.4 | 30 |
| Comparative Example 3 | $3 \times 10^{13}$ | $2 \times 10^{2}$ | $4 \times 10^{3}$ | 1.26 | 6 | 20 |
| Comparative Example 4 | $2 \times 10^{12}$ | $1 \times 10^{3}$ | 100 | 1.3 | 7 | 2 |

TABLE 3-continued

| | | | | | | |
|---|---|---|---|---|---|---|
| Comparative Example 5 | $3 \times 10^{14}$ | $3 \times 10^{3}$ | $2 \times 10^{5}$ | 1.26 | 6.8 | 30 |

(8) Production of Developers

To 100 parts of each toner particles is added 2.5 parts of spherical silica (obtained by a sol-gel method and treated with hexamethyldisilazane, mean primary particle size: 140 nm, sphericity degree ψ: 0.90) as an external additive, and then they are blended at a peripheral velocity of 40 m/s for 10 minutes in a 20-L Henschel mixer. Thereafter, thereto are added 1.2 parts of rutile type titanium oxide (treated with n-decyltrimethoxysilane, primary particle size: 20 nm), and then the components are blended at a peripheral velocity of 40 m/s for 5 minutes. Thereafter, a sieve having openings of 45 μm diameter is used to remove coarse particles, thereby yielding an electrostatic image developing toner.

7 parts of the toner is mixed with 93 parts of a resin-coated carrier to produce an electrophotographic developer. The resin-coated carrier is a carrier in which 100 parts of ferrite particles (mean particle size: 50 μm) are coated with 2 parts of styrene/methyl methacrylate (component ratio: 90/10), wherein in the 2 parts of styrene/methyl methacrylate, 0.2 part of carbon black (trade name: R330, manufactured by Cabot Corp.) has been dispersed.

(9) Evaluation of Fixing Properties

Each of the developers produced in the item (8) is used to measure the lowest fixable temperature, and the temperature at which hot offset occurred. From the results, the fixing latitude thereof is obtained. The results are shown in Table 3.

1) Lowest Fixable Temperature:

An image forming device (obtained by remodeling a device (trade name: DOCUPRINT 305, manufactured by Fuji Xerox Co., Ltd.) into a 2-component toner developing apparatus) by which the image forming method of the invention can be carried out, is used to measure the lowest fixable temperature. A fixing roll in this image forming device has been produced by coating the surface of an aluminum roll core with an alumite film. A silicone oil is supplied at a rate of 0.1 mg/A4 onto the roll from an oil roll. The thermal conductivity of the alumite film, which is the surface material of the fixing roll, is 30 W/mK.

A toner image is fixed on a sheet at every 5° C. elevation of the fixing roll surface temperature starting from 60° C. The toner amount of the solid area of the image is adjusted to be 0.5 mg/cm$^2$. The sheet is inward folded so as to form a fold along a substantial center line of the fixed image. The broken portion of the fixed image is wiped with a piece of tissue paper, and the width of the white line caused by detachment of the toner is measured. The temperature at which the width becomes 0.5 mm or less is defined as the lowest fixable temperature. The sheet to be used in the measurement is a J sheet manufactured by Fuji Xerox Co., Ltd.

2) Hot Offset Occurrence Temperature:

The same image forming device as used in the item 1) is used to measure the hot offset temperature. A sheet portion which is one roll-circumference after the solid image area on the sheet is observed, and the occurrence of hot offset is checked with the naked eye. The temperature at which hot offset occurs is defined as the hot offset occurrence temperature.

3) Fixing Latitude:

The fixing latitude is obtained by subtracting the lowest fixing temperature from the hot offset occurrence temperature.

Examples 4 and 5

In these examples, toners having sea-island structures are described.

The non-crystalline resin G liquid dispersion, crystalline resin liquid dispersion, coloring agent liquid dispersion and releasing agent liquid dispersion, in respective amounts shown in Table 2, are charged into a round flask made of stainless steel. While a homogenizer (trade name: ULTRA-TURRAX T50, manufactured by IKA Co.) is used to mix and disperse the components sufficiently in the mixed liquid dispersions, a coagulant is added thereto. Thereafter, the round flask is kept at 52° C. in a heating oil bath for 60 minutes while stirred. In this way, an aggregated particle liquid dispersion is prepared. Next, to this aggregated particle liquid dispersion is added an aqueous sodium hydroxide solution (0.5 mole/liter) so as to adjust the pH of the liquid dispersion to 7.5. Thereafter, the flask is sealed up. The liquid dispersion is kept at 90° C. for 1 hour while a magnetic force seal is used to stir the liquid dispersion.

(Washing)

The liquid dispersion is sufficiently washed with ion exchange water, and is then subjected to solid-liquid separating operation by Nutsche suction filtration. Furthermore, the separated solid is again dispersed in 3 liter of ion exchange water having a temperature of 40° C., and then the liquid dispersion is stirred at 300 rpm for 15 minutes and subsequently subjected to solid-liquid separating operation by Nutsche suction filtration. This washing operation is repeated until the pH of the filtrate becomes a value of 6.5 to 7.5 and the electric conductivity thereof becomes a value of 10 μS/cm or less. When the pH and the electric conductivity of the filtrate come within the above ranges, a filter paper (trade name: ADVANTEC 131) is used to subject the filtrate to solid-liquid separating operation by Nutsche suction filtration. The resultant solid is subjected to vacuum-drying at room temperature for 12 hours to obtain toner particles.

Example 6

A core-shell structure toner is produced in the same way as in Example 1 except that the crystalline resin A is changed to the crystalline resin B and the amount of the coagulant is increased.

Example 7

In this example, which involves a color toner, a cyan toner is produced in the same way as in Example 1 except that a cyan pigment is used instead of the carbon black. A developer is produced in the same way as in Examples 1 to 3.

This developer is used to evaluate toner properties and fixing properties thereof in the same way as in Example 1. The results are shown in Table 4.

Comparative Example 3

A core-shell structure toner is produced and then a developer is produced in the same way as in Example 1 except that the coagulant is changed from 0.3 g of polyaluminum chloride to 0.94 g of calcium chloride in the preparation of the core liquid dispersion and further the amount of the polyaluminum chloride in the production of the shells is changed from 0.018 g to 0.03 g.

Comparative Example 4

A toner and a developer are produced in the same way as in Example 1 except that no shells are formed on the cores.

Comparative Example 5

A sea-island structure toner and a developer are produced in the same way as in Example 5 except that the toner constitution is changed as shown in Table 1.

TABLE 4

| | Lowest fixable temperature | Hot offset occurrence temperature | Fixing latitude |
|---|---|---|---|
| Example 1 | 85° C. | 150° C. | 65° C. |
| Example 2 | 80° C. | 130° C. | 50° C. |
| Example 3 | 90° C. | 160° C. | 70° C. |
| Example 4 | 90° C. | 180° C. | 90° C. |
| Example 5 | 90° C. | 185° C. | 95° C. |
| Example 6 | 85° C. | 160° C. | 75° C. |
| Example 7 | 85° C. | 150° C. | 65° C. |
| Comparative Example 1 | 80° C. | 140° C. | 60° C. |
| Comparative Example 2 | 85° C. | 125° C. | 40° C. |
| Comparative Example 3 | 85° C. | 100° C. | 15° C. |
| Comparative Example 4 | 80° C. | 110° C. | 30° C. |
| Comparative Example 5 | 120° C. | 200° C. | 80° C. |

The results shown in Table 4 clearly indicate that toners including a crystalline resin and having a toner resistance and dynamic viscosity coefficients when melted within the ranges defined in the invention exhibit excellent electric chargeability, preferable lowest fixable temperature and excellent fixing latitude.

The toner of the invention, which has a core-shell structure or a sea-island structure and which has a resistance and a dynamic viscosity coefficients at temperatures which are respectively 50° C. higher and 10° C. higher than the melting point of the crystalline resin in the toner provides well-balanced low-temperature fixability, electric chargeability and offset resistance, which are difficult to attain with conventional toners. Since the toner of the invention has a broad fixing temperature range, the toner can be used without any difficulty for image formation involving fixation device having a fixing surface member with a high thermal conductivity. The image forming method of the invention makes it possible to fix an image at a very low temperature with lower energy to provide image of high quality, owing to combination of use of a crystalline resin in a toner and use of a fixing member having a surface with a high thermal conductivity.

What is claimed is:

1. An electrophotographic toner having a core-shell structure including a crystalline polyester in its core region or a sea-island structure including a crystalline polyester in its island region, wherein the crystalline polyester is exposed on less than 20% of a surface area of the toner, and the toner has 1) a resistance of $5.0\times10^{12}$ Ω·cm or higher, 2) a dynamic viscosity coefficient of $3\times10^{3}$ Pa·s or higher at a temperature which is 50° C. higher than a melting point of the crystalline polyester, and 3) a dynamic viscosity coefficient of $1\times10^{5}$ Pa·s or lower at a temperature which is 10° C. higher than the melting point of the crystalline polyester.

2. The toner according to claim 1, wherein a proportion of the crystalline polyester is 30% by mass to 90% by mass.

3. The toner according to claim 1, wherein the melting point of the crystalline polyester is 40° C. to 100° C.

4. The toner according to claim 1, wherein a weight-average molecular weight of the crystalline polyester is 8,000 to 100,000.

5. The toner according to claim 1, further comprising a releasing agent in an amount of 0.1% by mass to 20% by mass.

6. The toner according to claim 5, wherein the releasing agent has a melting point of 40 to 150° C.

7. The toner according to claim 1, further comprising silica particles.

8. The toner according to claim 7, wherein the silica particles were subjected to a hydrophobicity-imparting treatment.

9. The toner according to claim 7, wherein a volume-mean particle diameter of the silica particles is 1 nm to 1,000 nm.

10. The toner according to claim 1, wherein a volume-mean particle diameter of the toner is 3 to 20 μm.

11. The toner according to claim 1, wherein a volume-particle-diameter distribution of the toner is 1.35 or less.

12. A developer comprising a toner and a carrier, wherein the toner has a core-shell structure including a crystalline polyester in its core region or a sea-island structure including a crystalline polyester in its island region, the crystalline polyester is exposed on less than 20% of a surface area of the toner, and the toner has 1) a resistance of $5.0\times10^{12}$ Ω·cm or higher, 2) a dynamic viscosity coefficient of $3\times10^{3}$ Pa·s or higher at a temperature which is 50° C. higher than a melting point of the crystalline polyester, and 3) a dynamic viscosity coefficient of $1\times10^{5}$ Pa·s or lower at a temperature which is 10° C. higher than the melting point of the crystalline resin.

13. The developer according to claim 12, wherein a proportion of the crystalline polyester in the toner is 30% by mass to 90% by mass.

14. The developer according to claim 12, wherein a weight-average molecular weight of the crystalline polyester is 8,000 to 100,000.

15. The developer according to claim 12, wherein the carrier is coated with a resin.

16. An image forming method comprising:

forming an electrostatic latent image on a photoreceptor;

developing the electrostatic latent image by using a developer comprising a toner and a carrier to form a toner image;

transferring the toner image onto a image receiving body; and thermally fixing the toner image on the image receiving body, wherein the toner has a core-shell structure including a crystalline polyester in its core region or a sea-island structure including a crystalline polyester in its island region, the crystalline polyester is exposed on less than 20% of a surface area of the toner, and the toner has 1) a resistance of $5.0\times10^{12}$ Ω·cm or higher, 2) a dynamic viscosity coefficient of $3\times10^{3}$ Pa·s or higher at a temperature which is 50° C. higher than a melting point of the crystalline polyester, and 3) a dynamic viscosity coefficient of $1\times10^5$ Pa·s or lower at a temperature which is 10° C. higher than the melting point of the crystalline polyester.

17. The method according to claim 16, wherein the thermal fixing of the toner is conducted by an electrophotographic fixing device comprising a fixing member and the fixing member has a surface with a thermal conductivity of 1 W/mK or higher.

18. The method according to claim 16, wherein a proportion of the crystalline polyester in the toner is 30% by mass to 90% by mass.

19. The method according to claim 16, wherein a weight-average molecular weight of the crystalline polyester is 8,000 to 100,000.

* * * * *